US008978540B2

(12) United States Patent
Xu et al.

(10) Patent No.: US 8,978,540 B2
(45) Date of Patent: Mar. 17, 2015

(54) CYLINDER

(75) Inventors: Huan-Fan Xu, Shenzhen (CN); Xue-Fei Peng, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 629 days.

(21) Appl. No.: 13/301,867

(22) Filed: Nov. 22, 2011

(65) Prior Publication Data

US 2013/0008304 A1 Jan. 10, 2013

(30) Foreign Application Priority Data

Jul. 4, 2011 (CN) ..... 2011 1 0185336

(51) Int. Cl.
*F01B 31/00* (2006.01)
*F15B 15/02* (2006.01)
*F15B 15/14* (2006.01)

(52) U.S. Cl.
CPC ..... *F15B 15/02* (2013.01); *F15B 15/1447* (2013.01)
USPC ..... 92/138; 92/129

(58) Field of Classification Search
CPC ..... F01B 7/04; F01B 7/16; F01B 7/00; F01B 4/009; F01B 11/04; F01B 11/001; F01B 23/10; F15B 15/14; F16J 1/10
USPC ..... 92/129, 138; 74/110, 160
See application file for complete search history.

(56) References Cited

U.S. PATENT DOCUMENTS

| | | | | |
|---|---|---|---|---|
| 3,112,654 | A * | 12/1963 | Baumann | 74/110 |
| 2001/0020413 | A1 * | 9/2001 | Hirano et al. | 91/394 |
| 2010/0101408 | A1 * | 4/2010 | Keel | 92/129 |
| 2013/0152713 | A1 * | 6/2013 | Kim | 74/30 |

FOREIGN PATENT DOCUMENTS

WO WO 2009034852 A1 * 3/2009 ..... F15B 15/22

* cited by examiner

*Primary Examiner* — Dwayne J White
*Assistant Examiner* — Matthew Wiblin
(74) *Attorney, Agent, or Firm* — Novak Druce Connolly Bove + Quigg LLP

(57) ABSTRACT

A clamping cylinder is disclosed. The cylinder includes a cylinder block defining a receiving chamber and two vents communicating with the receiving chamber, the cylinder block further defining a through hole communicating with the receiving chamber at a side; a piston slidably mounted in the receiving chamber and defining a through groove corresponding to the through hole, the piston further comprising a resisting surface; and a pushrod assembly comprising a push block movably mounted in the through hole, and a resilient member mounted in the through groove, the resilient member is connected to the push block; wherein the resilient member is adapted to pull the push block towards the piston, and the resisting surface is configured to resist the push block so that the push block moves along the through hole when the piston slides along the receiving chamber.

20 Claims, 4 Drawing Sheets

CYLINDER

BACKGROUND

1. Technical Field

The present disclosure relates to driving mechanisms, and more particularly, to a clamping cylinder.

2. Description of Related Art

A cylinder may be used to clamp materials. Many cylinders may include a cylinder block defining a receiving chamber, a piston and a push rod received in the receiving chamber. The cylinder block may define two openings at opposite ends communicating with the receiving chamber. The piston may be movably received in the receiving chamber, a first end of the push rod may be fixed to the piston, and a second end of the push rod may extend out of the cylinder body via one opening. Airborne contaminants, such as dust particles, in a production facility may abrade and jam the piston and the push rod, and shorten the life of the cylinder. Moreover, the volume of the cylinder may be relatively large, and a significant amount of space may be needed to enable the cylinder to work.

Therefore, there is room for improvement in the art.

BRIEF DESCRIPTION OF THE DRAWINGS

The components in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
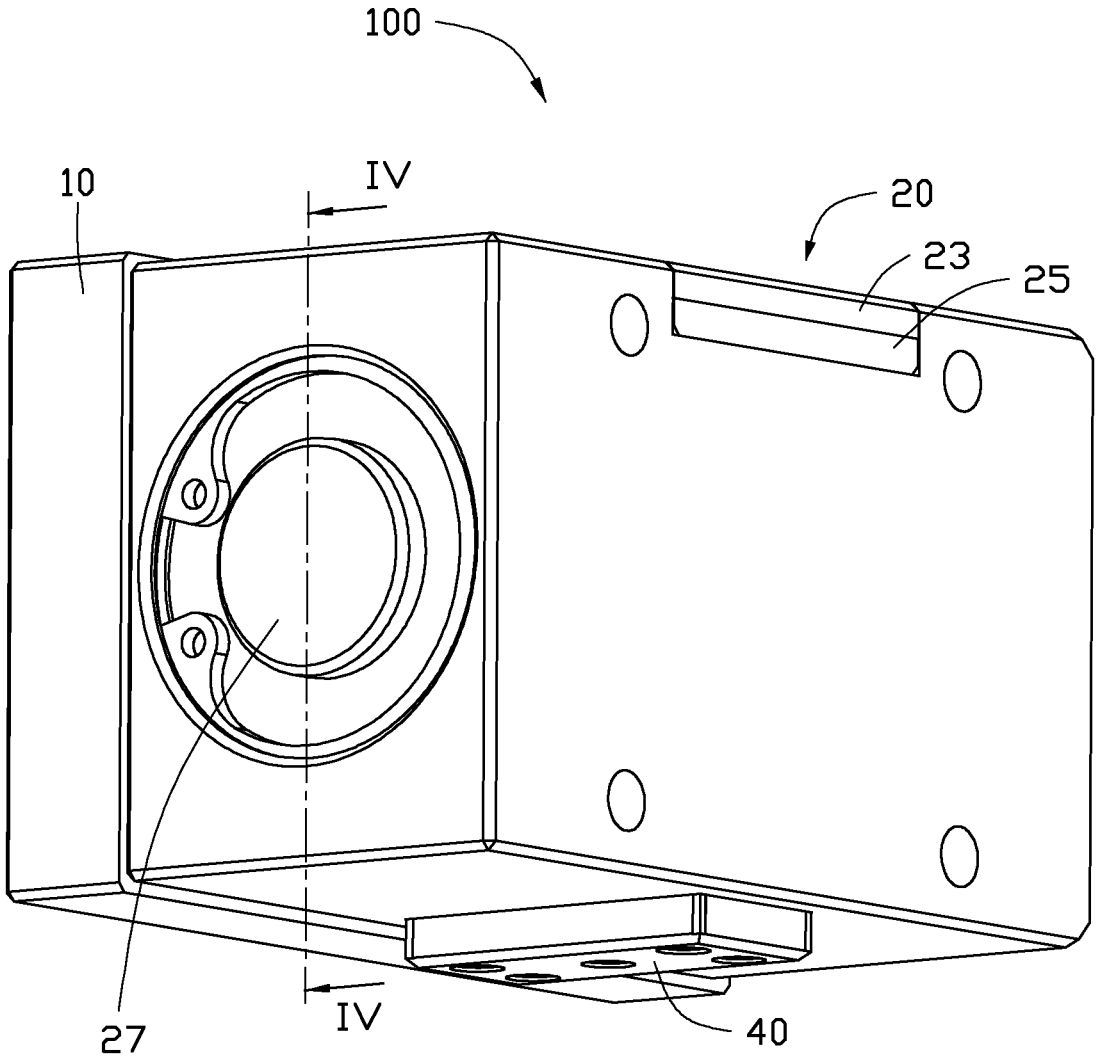
FIG. 1 is an isometric view of an embodiment of an assembled cylinder.
Figure 2:
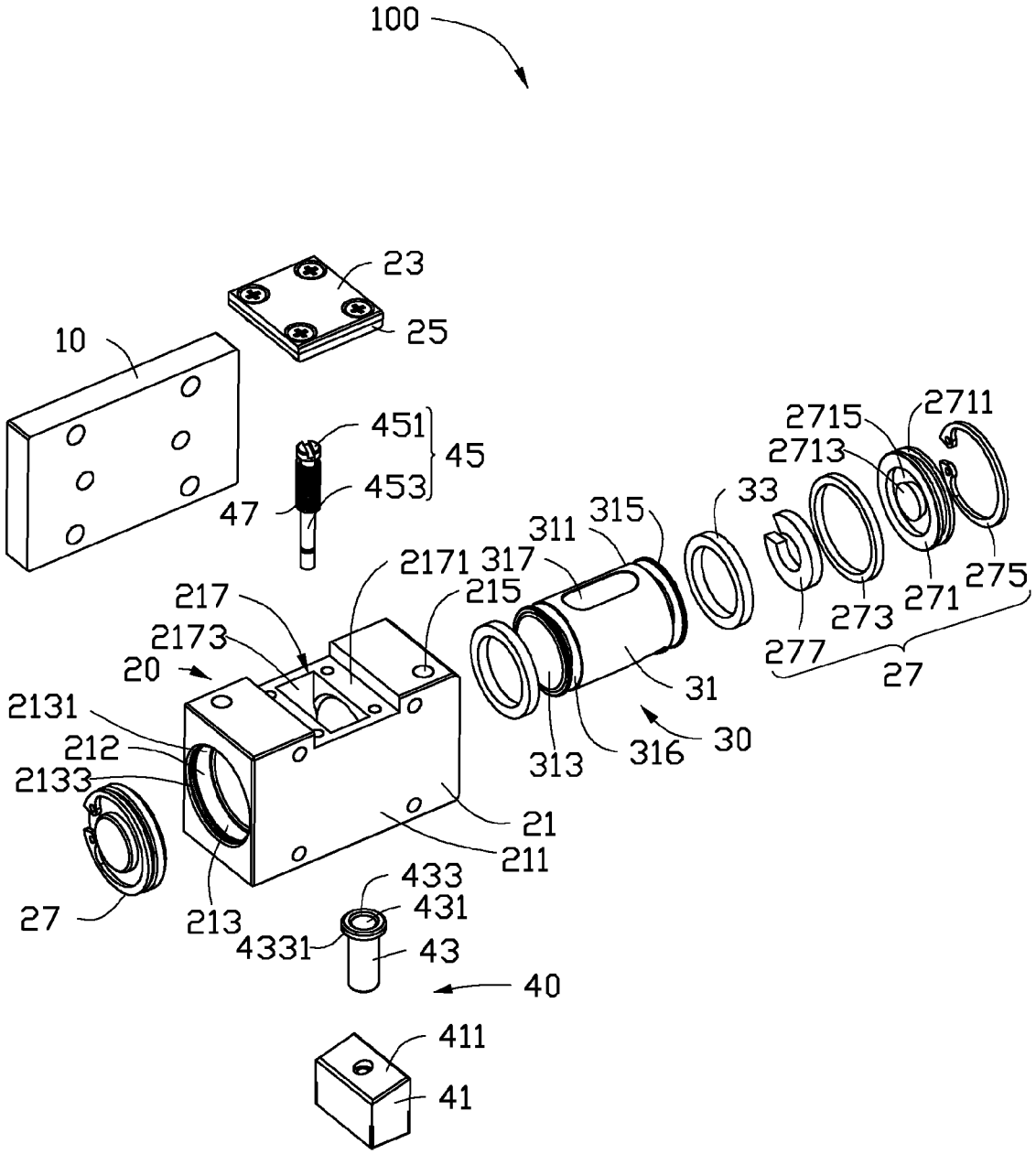
FIG. 2 is an exploded, isometric view of the cylinder of FIG. 1.

Referring to FIGS. 1 and 2, an embodiment of a cylinder 100 includes a mounting plate 10, a cylinder block 20, a piston 30, and a pushrod assembly 40. The cylinder block 20 includes a main body 21 defining a receiving chamber 212. The mounting plate 10 is mounted on a side of the cylinder block 20, the piston 30 is slidably installed in the receiving chamber 212, the pushrod assembly 40 is movably mounted in the receiving chamber 212 and an end of the pushrod assembly 40 extends perpendicularly out of the cylinder block 20. The pushrod assembly 40 is capable of being driven by the piston 30 and moving in or out of the cylinder 100 to clamp or release a workpiece.

The mounting plate 10 is a substantially rectangular and defines a plurality of mounting holes (not shown) for mounting the cylinder block 20.

The cylinder block 20 includes a first cover 23, a second cover 25, and two sealing assemblies 27. The first cover 23 and the second cover 25 are together and located at a side of the main body 21. The two sealing assembles 27 are mounted on opposite ends of the main body 21 to seal the receiving chamber 212.

Figure 3:
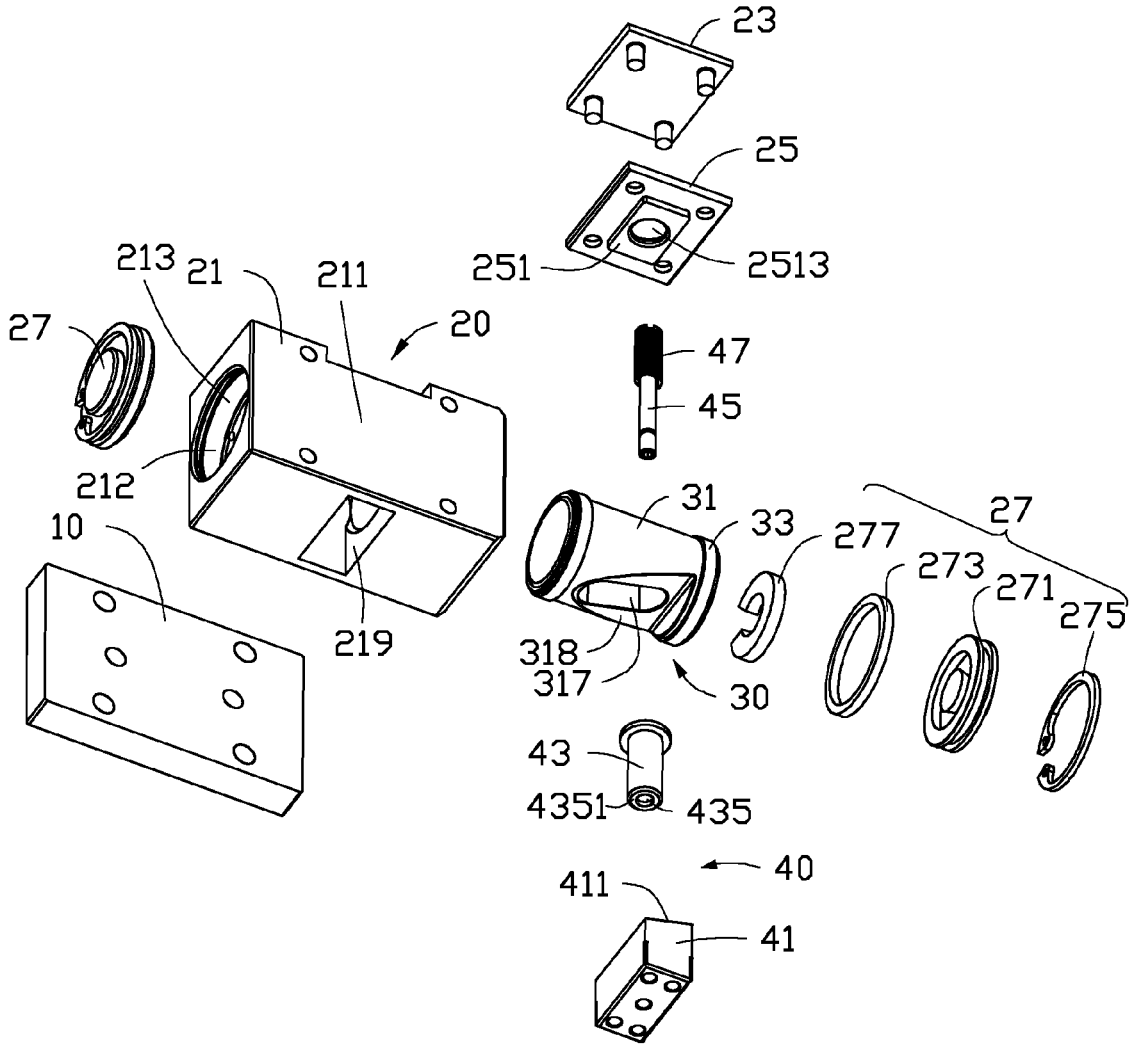
FIG. 3 is similar to FIG. 2, but viewed from another perspective.
Figure 4:
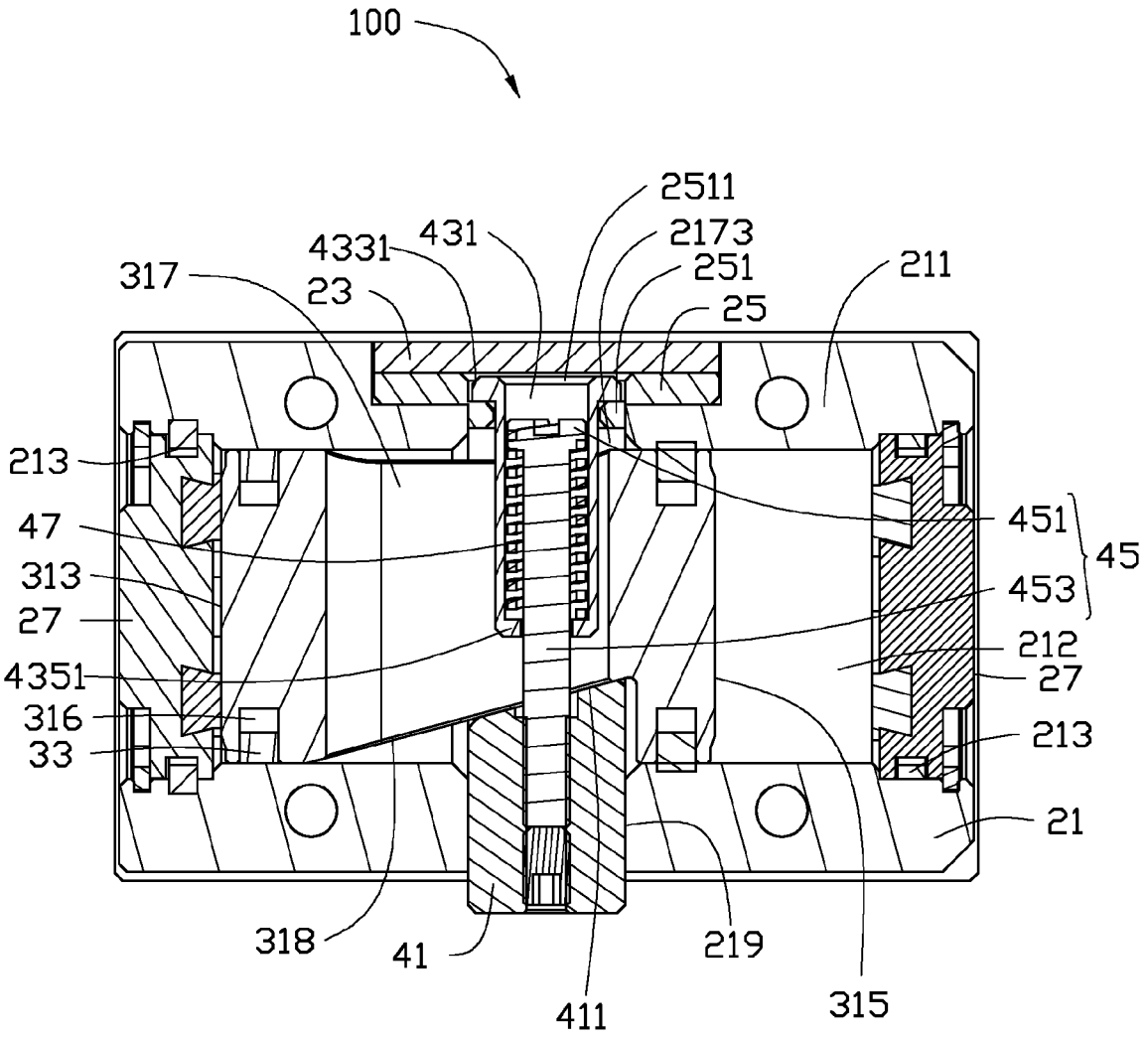
FIG. 4 is a cross-sectional view of the cylinder of FIG. 1, taken along line IV-IV.

Also referring to FIGS. 3 and 4, the main body 21 is a cuboid hollow structure comprising peripheral walls 211 in a rectangle housing shape. The receiving chamber 212 extends a length of the main body 21. The main body 21 further defines two openings 213 interconnecting with the receiving chamber 212 at opposite ends. The peripheral walls 211 define two vents 215 adjacent to the two openings 213, a mounting recess 217, and a through hole 219 at opposite sides. The two vents 215 are located at one side of the peripheral walls 211 and are interconnected with the receiving chamber 212. The mounting recess 217 is located between the two vents 215. The peripheral walls 211 further include a mounting surface 2171 corresponding to the mounting recess 217. The mounting surface 2171 defines a fixing hole 2173 interconnecting with the receiving chamber 212 in the mounting recess 217. In the embodiment, the receiving chamber 212 is a hollow cylinder. The two openings 213 are substantially circular, and each of the two openings 213 has a diameter greater than a diameter of the receiving chamber 212. The peripheral walls 211 further include a first joint portion 2131, and a second joint portion 2133 corresponding to each of the two openings 213. The first joint portion 2131 and the second joint portion 2133 are positioned side by side and cooperatively form a stepped annular structure. The first joint portion 2131 is at an end of the receiving chamber 212, and the second joint portion 2133 is separated from the receiving chamber 212 by the first joint portion 2131. In the embodiment, the fixing hole 2173 and the through hole 219 are substantially rectangular.

The first cover 23 and the second cover 25 are rectangular and function as one unit. The first cover 23 is located on the mounting recess 217 and seals the fixing hole 2173. The second cover 25 includes a position portion 251 located on an underside of the second cover 25 facing the fixing hole 2173. The second cover 25 defines a containing chamber 2511 at a second side opposite to a first side. The second cover 25 further defines a hole 2513 in the position portion 251 communicating with the containing chamber 2511. The position portion 251 is capable of engaging in the fixing hole 2173.

The two sealing assemblies 27 are mounted in the two openings 213. Each of the two sealing assembly 27 includes a sealing member 271, a blocking ring 273, an internal circlip 275, and a buffering member 277. The sealing member 271 is fixed to the first joint portion 2131 in each of the two openings 213. The sealing member 271 is substantially a round disk. The sealing member 271 defines a sealing groove 2711 on a periphery, and includes a post 2713 in the middle of an end. The post 2713 and the periphery of the sealing member 271 cooperatively define an annular receiving space 2715. The blocking ring 273 is a ring sleeved on the sealing member 271 and engaged in the sealing groove 2711. The buffering member 277 is a split rubber ring which is press fit in the receiving space 2715.

The piston 30 is received in the receiving chamber 212 and is capable of sliding between the two openings 213 of the cylinder block 20. The piston 30 includes a base body 31, and two sealing rings 33. The base body 31 is substantially cylindrical in shape and includes a side surface 311, a first end surface 313, and a second end surface 315. The base body 31 further defines two annular grooves 316 on the side surface 311, adjacent to the first and second surfaces 313, 315; and a through groove 317 located between the two annular grooves 316. The through groove 317 has a shape of a thin oval. The base body 31 further includes a resisting surface 318 in the side surface 311 corresponding to the through hole 219. In the embodiment, the resisting surface 318 has an inclined surface, and distances between the resisting surface 318 and an inner surface of the peripheral walls 211 increase from the first end surface 313 toward the second end surface 315 of the piston 30. The two sealing rings 33 are mounted in the two annular grooves 316 to provide a hermetic seal for the piston 30.

The pushrod assembly 40 is slidably mounted in the through groove 317 of the piston 30. The pushrod assembly 40 includes a push block 41, a sleeve 43, a sliding rod 45, and a resilient member 47. The push block 41 is substantially a solid cuboid block and slidably engages in the through hole 219. The push block 41 includes an inclined surface 411 at one end matching a profile of the resisting surface 318 of the piston 30. The sleeve 43 extends through the through groove 317 and is cylindrical around a receiving hole 431. When the piston 30 slides along the receiving chamber 212, the sleeve 43 is always retained in the through groove 317. The sleeve 43 further defines an opening 433 and a bottom hole 435. The sleeve 43 includes a first resisting portion 4331 and a second resisting portion 4351. The opening 433 and the bottom hole 435 are located at opposite ends of the sleeve 43 and communicate with the receiving hole 431. The first resisting portion 4331 surrounds the opening 433, and the second resisting portion 4351 surrounds the bottom hole 435. The first resisting portion 4331 is an external flange with a diameter greater than a diameter of the sleeve 43. The second resisting portion 4351 is an internal flange with a diameter smaller than an interior diameter of the sleeve 43. The sliding rod 45 slidably extends through the bottom hole 435. The sliding rod 45 includes a head portion 451 received in the receiving hole 431 of the sleeve 43, and a rod portion 453 opposite to the head portion 451. The rod portion 453 is partially received in the receiving hole 431. One end of the rod portion 453 extends out of the sleeve 43 and is fixed to the inclined surface 411 of the push block 41. The resilient member 47 is sleeved on the rod portion 453 of the sliding rod 45 and positioned between the head portion 451 and the second resisting portion 4351.

In assembly, the piston 30 is received in the receiving chamber 212 to divide the receiving chamber 212 into two parts (not labeled), the resisting surface 318 facing the through hole 219. One blocking ring 273 is received into the sealing groove 2711 of one of the two sealing members 271. One buffering member 277 is sleeved on the post 2713 and pressed into the receiving space 2715. One sealing member 271 engages in one of the two openings 213 with the post 2713 facing the receiving chamber 212. The periphery of the blocking ring 273 resists the first joint portion 2131, the internal circlip 275 is compressed to be installed against the sealing member 271 and the second joint portion 2133, such that one of the two sealing assemblies 27 is assembled and held captive in the main body 21. Similarly, another one of the two sealing assemblies 27 is assembled to the main body 21 with another one of the two openings 213.

The second cover 25 is fixed to the mounting surface 2171 of the mounting recess 217 with the position potion 251 extending into the fixing hole 2173. The resilient member 47 is sleeved on the rod portion 453, and the sliding rod 45 extends into the receiving hole 431 of the sleeve 43. The sleeve 43 extends into the hole 2513 of the second cover 25, and into the through groove 317 of the piston 30. The first resisting portion 4331 is received in the containing chamber 2511 to prevent detachment of the sleeve 43 from the second cover 25. The head portion 451 of the sliding rod 45 is pressed towards the bottom hole 435. One end of the sliding rod 45 extends into the through groove 317. The push block 41 is slidably mounted in the through hole 219 with the inclined surface 411 facing the resisting surface 318 of the piston 30. The end of the sliding rod 45 furthest from the head portion 451 is fixed to the inclined surface 411. The head portion 451 is released, so that the resilient member 47 resists the head portion 451 and the second resisting portion 4351 to enable the sliding rod 45 to pull the push block 41 towards the piston 30. The first cover 23 is fixed to the second cover 25 to entirely seal the cylinder block 20. The assembly of the cylinder 100 is completed.

When in use, the two vents 215 communicate with two gas supplies (not shown) for supplying pressurized gas to the receiving chamber 212. When there is more air pressure upon the first end surface 313, the piston 30 is pushed toward one of the two openings 213. The resisting surface 318 moves along the receiving chamber 212. As the distance between the resisting surface 318 and the inner surface of the peripheral walls 211 decreases, the push block 41 is moved outwardly from the cylinder block 20 via the through hole 219. The push block 41 then has a clearance for clamping a workpiece. In reverse, when there is less air pressure upon the first surface 313, the piston 30 moves towards the first end surface 313 and the resilient member 47 pulls the push block 41 back. At the same time, the resilient member 47 is released and pulls the sliding rod 45 toward the second cover 25. The sliding rod 45 and the air pressure together pull the push block 41 inwards, such that the push block 41 moves inwards via the through hole 219 and thereby releases the workpiece.

Since the cylinder block 20 is entirely sealed and the push block 41 communicates with the outside only via the through hole 219, dust particles have very little opportunity of entering into the receiving chamber 212 of the cylinder block 20. Therefore, incidents of jamming problems caused by ingress of foreign matters and particles may decrease sharply. As the piston 30 moves between the two openings 213, and the push block 41 moves perpendicularly to the piston 30, the fitting and working space required for the cylinder 100 may be decreased. Moreover, since the piston 30 pushes on the push block 41 by means of the resisting surface 318 to resist the inclined surface 41, it may be almost impossible for the pushrod assembly 40 to be broken.

The distance between the resisting surface 318 and the inner surface of the peripheral walls 211 may be decreased from the first end surface 313 towards the second end surface 315. In other words, an angle of inclination from the surface 318 to the peripheral walls 211 may be decreased. In other embodiments, the resisting surface 318 may have other shapes, such as a curved surface with the distance between the curved surface and the inner surface of the peripheral walls 211 increasing from the first end surface 313 towards the second end surface 315. The two sealing assemblies 27 may be omitted if the cylinder block 20 is formed integrally, with both ends blind.

Finally, while various embodiments have been described and illustrated, the disclosure is not to be construed as being restricted thereto. Various modifications can be made to the embodiments by those skilled in the art without departing from the true spirit and scope of the disclosure as defined by the appended claims.

What is claimed is:

1. A cylinder, comprising:

a cylinder block defining a receiving chamber and two vents communicating with the receiving chamber, the cylinder block further defining a through hole communicating with the receiving chamber at a side;

a piston slidably mounted in the receiving chamber and defining a through groove corresponding to the through hole, the piston further comprising a resisting surface; and a pushrod assembly comprising a push block movably mounted in the through hole, and a resilient member mounted in the through groove, the resilient member connected to the push block; wherein the resilient member is adapted to pull the push block towards the piston, and the resisting surface is configured to resist the push block so that the push block moves along the through hole when the piston slides along the receiving chamber.

2. The cylinder of claim 1, wherein the cylinder block comprises a main body, the receiving chamber extends along a length of the main body; the main body defines two openings at opposite ends of the main body, the two openings are interconnected with the receiving chamber; each of the two vents is located at a side of the main body, one of the two vents is adjacent to one of the two openings, and another one of the two vents is adjacent to another one of the two openings.

3. The cylinder of claim 1, wherein the pushrod assembly further comprises a sliding rod; the sliding rod comprises a head portion and a rod portion, an end of the rod portion is fixed to the push block, the resilient member is sleeved on the rod portion and is adapted to resist the head portion to enable the sliding rod to pull the push block toward the piston.

4. The cylinder of claim 3, wherein the pushrod assembly further comprises a sleeve extending in the through groove of the piston; the sleeve is cylindrical around a receiving hole; the sleeve defines an opening, and a bottom hole at opposite ends; the sleeve is interconnected with the receiving hole through the bottom hole; the resilient member and the head portion of the sliding rod are received in the receiving hole; and the rod portion is partially received in the receiving hole.

5. The cylinder of claim 4, wherein the sleeve further comprises a first resisting portion surrounding the opening, and a second resisting portion surrounding the bottom hole; the first resisting portion is an external flange, and the second resisting portion is an internal flange, the resilient member is positioned between the head portion and the second resisting potion.

6. The cylinder of claim 2, wherein the main body further defines a mounting recess between the two vents, and a fixing hole in the mounting recess, the fixing hole is interconnected with the receiving chamber; the main body further comprises a first cover, and a second cover; the second cover comprises a position portion at a first side, and defines a containing chamber at a second side opposite to the first side; the position portion engages in the fixing hole to seal the main body.

7. The cylinder of claim 6, wherein the second cover further defines a hole in the position portion, the hole is interconnected with the containing chamber; the pushrod assembly further comprises a sleeve and a sliding rod, the sleeve extends into the through groove of the piston and is cylindrically around a receiving hole; the resilient member is sleeved on the sliding rod, the sliding rod is partially received in the receiving hole, and an end of the sliding rod is fixed to the push block, the sleeve extends into the hole of the second cover, an end of the sleeve is received in the containing chamber to prevent detachment of the sleeve from the second cover.

8. The cylinder of claim 1, wherein the piston comprises a base body, and two sealing rings; the base body is substantially cylindrical and comprises an side surface, a first end surface, and a second end surface; the base body further defines two annular grooves on the side surface, one of the two annular grooves is adjacent to the first end surface, and another one of the two annular grooves is adjacent to the second end surface; each of the two sealing rings is received in corresponding one of the two annular grooves.

9. The cylinder of claim 8, wherein the through groove has a shape of a thin oval, and the pushrod assembly further comprises a sleeve, the sleeve is retained in the through groove when the piston slides along the receiving chamber.

10. The cylinder of claim 8, wherein the resisting surface is an inclined surface on the side surface of the base body, and the push block comprises an inclined surface configured to be engaged with the resisting surface of the piston.

11. The cylinder of claim 8, wherein the cylinder block defines two openings at opposite ends, the two openings are interconnected with the receiving chamber and comprises two sealing assemblies mounted in the two openings respectively; each of the two sealing assemblies comprises a sealing member, a blocking ring, a internal circlip, and a buffering member; the sealing member is fixed in one of the two openings, the blocking ring is sleeved on the sealing member, the internal circlip is mounted at a first end of the sealing member, the buffering member and the blocking ring are mounted on a second end of the sealing member.

12. The cylinder of claim 8, wherein the cylinder block comprises a main body having a peripheral wall in rectangle housing shape around the receiving chamber, the piston is received in the receiving chamber to divide the receiving chamber into two parts.

13. The cylinder of claim 12, wherein distances between the resisting surface of the piston and the inner surface of the peripheral walls of the receiving chamber increase from the first end surface toward the second end surface of the piston.

14. A cylinder, comprising:

a cylinder block comprising a receiving chamber axially, and a through hole interconnected with the receiving chamber;

a piston slidably mounted in the receiving chamber, the piston comprising a through groove corresponding to the through hole, and a resisting surface; and a pushrod assembly comprising a push block slidably mounted in the through hole, the push block comprising a inclined surface; and a resilient member connected to the push block and mounted in the through groove; wherein the resilient member is adapted to pull the push block toward the piston, and the resisting surface resists the inclined surface so that the push block moves along the through hole when the piston slides along the receiving chamber.

15. The cylinder of claim 14, the cylinder block comprises a main body of a cuboid shape, the receiving chamber extends along a length of the main body, the main body further comprises two openings at opposite ends of the main body, and two vents; the two openings are interconnected with the receiving chamber, and each of the two vents is at one side of the main body, one of the two vents is adjacent to one of the two openings, and another one of the two vents is adjacent to another one of the two openings.

16. The cylinder of claim 15, the main body further comprises a mounting recess between the two vents, a fixing hole in the mounting recess, a first cover, and a second cover; wherein the fixing hole is interconnected with the receiving chamber; the second cover comprises a position portion at a first side, and defines a containing chamber at a second side opposite to the first side; and the position portion engages in the fixing hole to seal the main body.

17. The cylinder of claim 16, the second cover further defines a hole interconnected with the containing chamber of the position portion; the pushrod assembly further comprises a sleeve, and a sliding rod; wherein the sleeve extends in the through groove of the piston, the sleeve is cylindrical around a receiving hole, the resilient member is sleeved on the sliding rod, the sliding rod is partially received in the receiving hole, an end of the sliding rod is fixed to the push block, the sleeve extends into the hole of the second cover, and an end of the sleeve is received in the containing chamber to prevent detachment of the sleeve from the second cover.

18. The cylinder of claim 14, the piston comprises a base body, and two sealing rings; the base body is in substantially cylindrical and comprises an side surface, a first end surface and a second end surface located at opposite ends of the base body; the base body further defines two annular grooves on the side surface; one of the two annular groves is adjacent to the first end surface, and another one of the two annular grooves is adjacent to the second end surface; and each of the two sealing rings is received in corresponding one of the two annular grooves.

19. The cylinder of claim 18, wherein the through groove has a shape of a thin oval, and the pushrod assembly further comprises a sleeve, the sleeve is retained in the through groove when the piston slides along the receiving chamber.

20. The cylinder of claim 18, the cylinder block comprises a main body having a peripheral wall in a rectangle housing shape around the receiving chamber, wherein distances between the resisting surface of the piston and the inner surface of the peripheral walls of the receiving chamber increase from the first end surface toward the second end surface.

* * * * *